US006874709B2

(12) United States Patent
Ricco

(10) Patent No.: US 6,874,709 B2
(45) Date of Patent: Apr. 5, 2005

(54) INTERNAL COMBUSTION ENGINE FUEL INJECTOR HAVING AN ELECTROMAGNETIC METERING VALVE

(75) Inventor: Mario Ricco, Casamassima (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 178 days.

(21) Appl. No.: 10/271,061

(22) Filed: Oct. 15, 2002

(65) Prior Publication Data

US 2003/0111558 A1 Jun. 19, 2003

(30) Foreign Application Priority Data

Oct. 12, 2001 (IT) ..... TO2001A0969

(51) Int. Cl.[7] ..... B05B 1/30

(52) U.S. Cl. ..... 239/585.1; 239/585.3; 239/585.5; 251/129.01

(58) Field of Search ..... 239/585.1, 585.3, 239/585.4, 585.5; 251/129.01, 129.16, 129.17

(56) References Cited

U.S. PATENT DOCUMENTS 4,356,980 A * 11/1982 Krauss ..... 239/585.3
4,390,130 A 6/1983 Linssen et al.
5,086,980 A 2/1992 Hickey
6,161,783 A * 12/2000 Press ..... 239/585.3
6,443,132 B1 * 9/2002 Ricco et al. ..... 123/467

FOREIGN PATENT DOCUMENTS

| | | |
|---|---|---|
| DE | 3143916 A1 | 5/1983 |
| DE | 19708104 A1 | 9/1998 |
| EP | 0 484 804 A1 | 5/1992 |
| WO | WO 99/57429 | 11/1999 |

* cited by examiner

*Primary Examiner*—Dinh Q. Nguyen
(74) *Attorney, Agent, or Firm*—Morgan & Finnegan, LLP

(57) ABSTRACT

The injector has a hollow body housing the body of the metering valve, which has a discharge hole for discharging the usual control chamber. The hole comes out at a flat surface of the valve body, and is engaged by a flat surface of a plate, under the control of an armature of an electromagnet. The armature is in the form of a disk, has substantially no stem, is connected to the hollow body by a leaf spring hinge, and has a surface having a spherical-bowl-shaped recess. A ball is located between the recess and another recess carried by a second surface of the plate. The valve body is fixed to the hollow body by a ring nut of a given height. And, to cover the distance between the valve body and the armature, a spacer member is preferably formed in one piece with the valve body.

7 Claims, 2 Drawing Sheets

INTERNAL COMBUSTION ENGINE FUEL INJECTOR HAVING AN ELECTROMAGNETIC METERING VALVE

The present invention relates to improvements to an internal combustion engine fuel injector having an electromagnetic metering valve.

BACKGROUND OF THE INVENTION

Known injectors of the above type comprise a hollow body for housing the metering valve body; the valve body has a calibrated hole for discharging high-pressure fuel from an injection control chamber; the calibrated hole is kept closed by a normally disk-type shutter controlled by the armature of a control electromagnet, and normally comes out at a conical depression in a surface of the valve body; the shutter comprises a ball cooperating with a plate engaged by the armature and having a spherical-bowl-shaped recess to eliminate any misalignment between the hole axis and displacement of the armature; and the valve body is locked inside a cavity in the hollow body by a ring nut, which requires a given distance between the electromagnet and the valve body.

Known injectors of this type have several drawbacks. In particular, the distance between the valve body and the electromagnet means the disk-type armature must be provided with a corresponding stem to act on the plate; the armature stem, in turn, calls for high-cost guide means, normally precision-machined sleeves; machining the valve body with the conical depression is also relatively expensive; and, finally, the conical depression increases the necessary length of the armature stem.

In one known injector, a valve body is proposed in which the calibrated hole comes out at a flat surface of the valve body, and is closed by a flat surface of a plate, another surface of which may also be flat and is engaged by a convex end of the armature stem. In an alternative solution, the other surface of the plate has a spherical-bowl-shaped recess engaged by a complementary appendix on the stem. This known injector does not eliminate the need for an armature stem, and, what is more, makes the armature stem even more expensive.

Another injector has recently been proposed, in which the valve body is defined by a sleeve force-fitted inside a cavity in the hollow body; and the disk-type armature is connected to the hollow body by a leaf spring hinge having one portion fixed to the hollow body, and one portion fixed to the armature. This reduces the distance between the valve body and the electromagnet, but, on account of the conical surface of the valve body at which the calibrated hole comes out, the disk-type armature, to act on the plate, calls for a spacer member normally carried by the armature.

This type of injector is also relatively expensive, on account of the spacer member and relative connection. Moreover, on account of the leaf spring hinge, the armature movement is not perfectly straight, so that the contact surfaces between the spacer member on the armature and the shutter plate are subject to relative transverse slippage, which reduces the sensitivity and reliability of the valve, and which increases alongside an increase in the distance of the point at which the spacer member engages the plate.

SUMMARY OF THE INVENTION

It is an object of the present invention to provide improvements to a fuel injector, such as to achieve a high degree of reliability and low cost, and to eliminate the aforementioned drawbacks of known injectors.

According to the present invention, there is provided an internal combustion engine fuel injector having an electromagnetic metering valve, and comprising a hollow body in which is housed a valve body having a calibrated discharge hole for discharging high-pressure fuel from a control chamber of the injector; said discharge hole coming out at a flat surface of said valve body; and said metering valve comprising a plate having a flat first surface for closing said discharge hole under the control of an armature of an electromagnet; characterized in that said armature is connected to said hollow body by a leaf spring hinge having a first portion fixed to said hollow body, and a second portion fixed to said armature; a ball being located between said armature and a second surface of said plate.

According to a further aspect of the invention, the valve body is housed inside a cavity of said hollow body, and is locked by a threaded ring nut; a spacer member being defined by an appendix projecting from said valve body towards said armature, so as to minimize the transverse movement, caused by said leaf spring hinge, of said plate with respect to said discharge hole.

BRIEF DESCRIPTION OF THE DRAWINGS

A number of preferred, non-limiting embodiments of the invention will be described by way of example with reference to the accompanying drawings, in which.

DETAILED DESCRIPTION OF THE INVENTION

Figure 1:
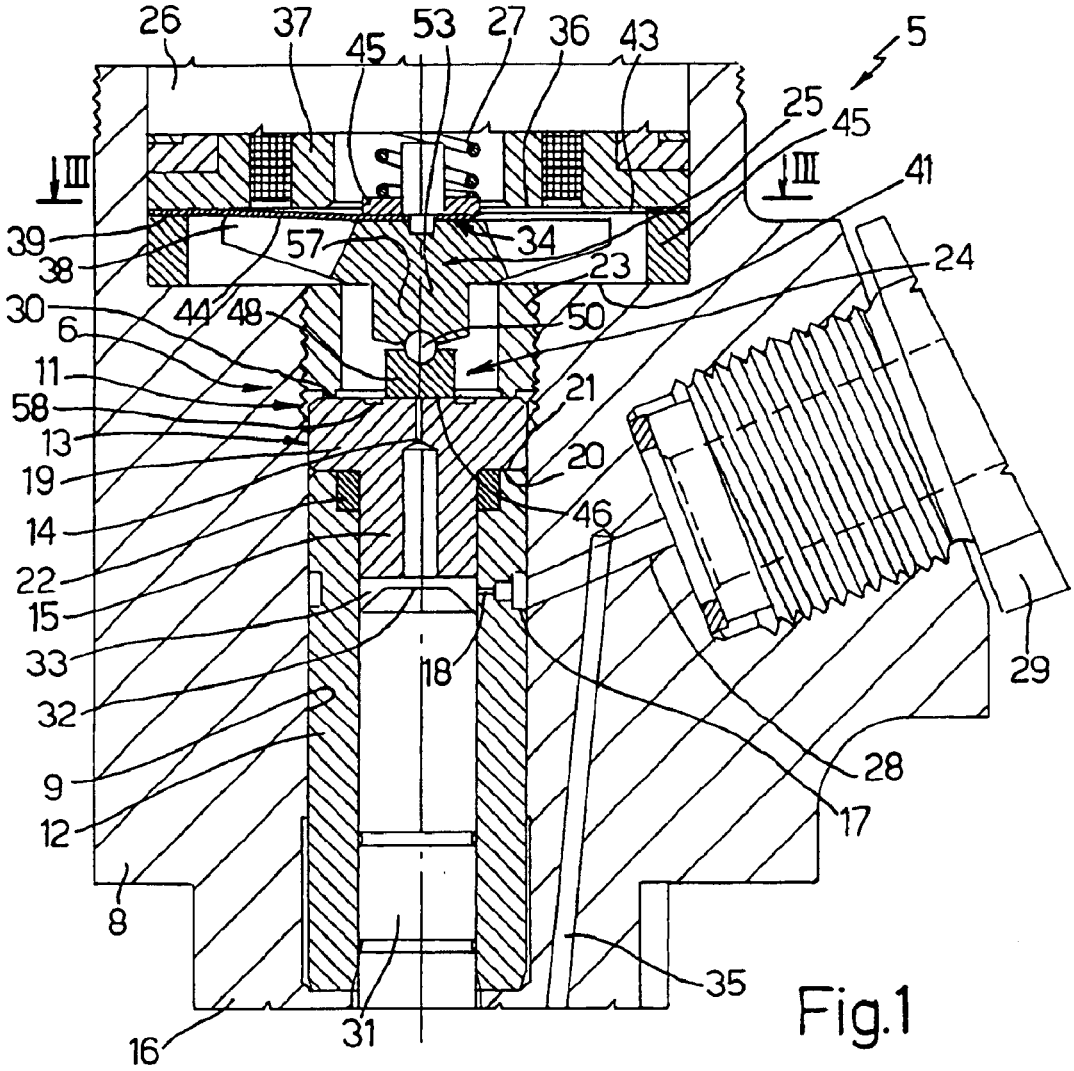
FIG. 1 shows a partial longitudinal section of an internal combustion engine fuel injector in accordance with a first embodiment of the invention.
Figure 3:
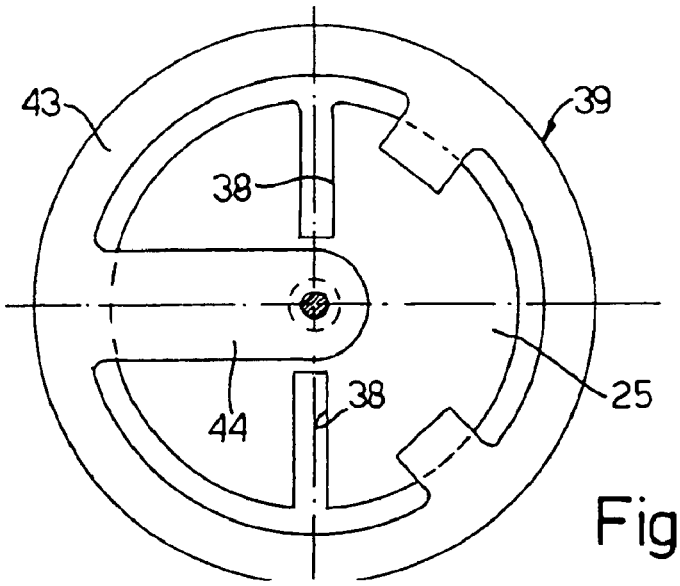
FIG. 3 shows a section along line III—III in FIGS. 1 and 2.

Number 5 in FIG. 1 indicates as a whole an internal combustion engine fuel injector having an electromagnetic metering valve 6. Injector 5 comprises a hollow body 8 having a central cavity 9 housing a body 11 of metering valve 6—hereinafter referred to as "valve body".

More specifically, valve body 11 is defined by a sleeve 12, and by a plug member 13 having an integral cylindrical appendix 15 housed in sleeve 12. Plug member 13 has a calibrated hole 14 for discharging fuel from metering valve 6; and sleeve 12 is force-fitted inside cavity 9, so as to rest on a shoulder 16 of cavity 9, and comprises an annular groove 17 in which is formed a calibrated inlet hole 18 by which pressurized fuel is fed into metering valve 6.

Plug member 13 comprises a disk-shaped portion 19 which forms a flat shoulder 20 with appendix 15; shoulder 20 rests, in use, on a top edge 21 of sleeve 12, so as to compress a seal 22; plug member 13 is locked against sleeve 12 by a threaded ring nut 23 screwed inside hollow body 8; and the ring nut acts on an annular portion 30 of the top surface of disk-shaped portion 19.

Calibrated hole 14 of plug member 13 is normally kept closed by a shutter—indicated as a whole by 24—which is kept in the closed position by an armature 25 of an electromagnet 26. Armature 25 is normally pushed downwards by a compression spring 27; annular groove 17 is located at the outlet of a feed conduit 28 communicating with a fitting 29 for feeding pressurized fuel to injector 5; and, via a substantially longitudinal conduit 35, conduit 28 also supplies a fuel atomizer nozzle carried by hollow body 8 and not shown in the drawings.

A nozzle control rod 31 slides inside sleeve 12, and comprises a top surface 32 which is normally kept a given distance from the bottom surface of appendix 15 of plug member 13 by the pressurized fuel entering a control chamber 33 of injector 5 through calibrated hole 18. Control chamber 33 is substantially defined by the gap between top surface 32 of rod 31 and the bottom surface of appendix 15 of plug member 13.

Armature 25 is substantially defined by a disk having a flat top surface 34 cooperating with a pole face 36 of the usual magnetic core 37 of electromagnet 26, and has radial slits 38 through which the fuel discharged flows, through calibrated hole 14, to a drain conduit (not shown) of injector 5.

Armature 25 is connected to hollow body 8 by a leaf spring hinge indicated as a whole by 39. For which purpose, core 37 of electromagnet 26 is locked in known manner against a shoulder 41 of hollow body 8 with the interposition of a spacer ring 42 made of rigid metal. Leaf spring hinge 39 (see also FIG. 2) comprises an annular portion 43 fixed to hollow body 8, in particular, gripped between core 37 and ring 42.

Leaf spring hinge 39 also comprises a portion defined by an elastic radial tongue 44 having one end integral with annular portion 43. The other end of tongue 44 is fixed to a central portion of armature 25, e.g. is gripped between armature 25 and a washer 45 in turn fixed to armature 25, so that the movement of armature 25 substantially comprises rotation about the point of connection of tongue 44 to annular portion 43.

Spacer ring 42 is of the minimum height enabling armature 25 to be housed and to move between shoulder 41 and annular portion 43 of leaf spring hinge 39; whereas, since ring nut 23 must be of considerable height for reasons of strength, the disk of armature 25 is located a given distance from the top surface of disk-shaped portion 19 of plug member 13.

To activate injector 5, electromagnet 26 is energized temporarily to attract armature 25 in opposition to the force of spring 27. Armature 25 rotates by a very small angle about the point of connection of tongue 44 to the annular portion of leaf spring hinge 39; the pressurized fuel in control chamber 33 therefore opens shutter 24, thus reducing the fuel pressure, so that rod 31 moves upwards to open the fuel atomizer nozzle.

When electromagnet 26 is deenergized, spring 27 restores armature 25 to the FIG. 1 position by rotating it by a very small angle in the opposite direction to the opening direction, thus closing shutter 24; the fuel pressure in control chamber 33 is therefore restored, so that rod 31 moves back down into the nozzle-closing position shown in FIG. 1.

To reduce the machining cost of plug member 13, discharge hole 14 comes out at a central portion 46 of the top surface of disk-shaped portion 19. The surface of portion 46 must be machined to a high degree of precision so as to be perfectly flat and perpendicular to the axis of discharge hole 14.

Figure 4:
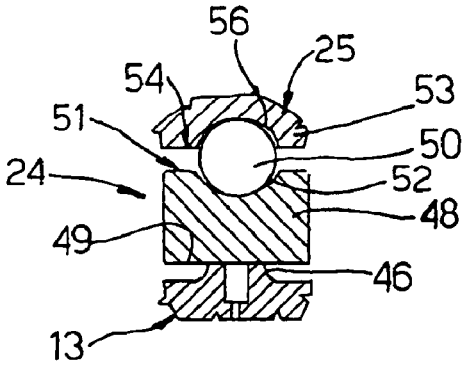
FIG. 4 shows a larger-scale detail of FIGS. 1 and 2.

Shutter 24 of discharge hole 14 comprises a plate 48 having a flat first surface 49 (see also FIG. 4) for engaging the surface of portion 46; and a ball 50 located between armature 25 and a second surface 51, opposite surface 49, of plate 48. And surface 51 has a spherical-bowl-shaped recess 52 for engaging ball 50.

Armature 25 in turn comprises a central portion 53 having a bottom surface 54 opposite top surface 34 of armature 25; and surface 54 also has a spherical-bowl-shaped recess 56 for engaging ball 50.

On account of the distance between the disk of armature 25 and the top surface 30, 46 of disk-shaped portion 19 in the FIG. 1 embodiment, central portion 53 of armature 25, to reduce the thickness of plate 48, may be carried by a spacer member defined by a cylindrical appendix 57 projecting towards plate 48; and the top surface of central portion 46 of disk-shaped portion 19 may in turn be coplanar with the surface of annular portion 30.

A shallow annular groove 58 between the surfaces of portions 30 and 46 ensures more effective closure of hole 14 by plate 48; and the spherical bowls of recesses 52 and 56 may advantageously be slightly larger in diameter than ball 50 to center ball 50 more easily.

The top surfaces of portions 30 and 46 of disk-shaped portion 19 may therefore be machined simultaneously, thus reducing the cost of plug member 13.

Figure 2:
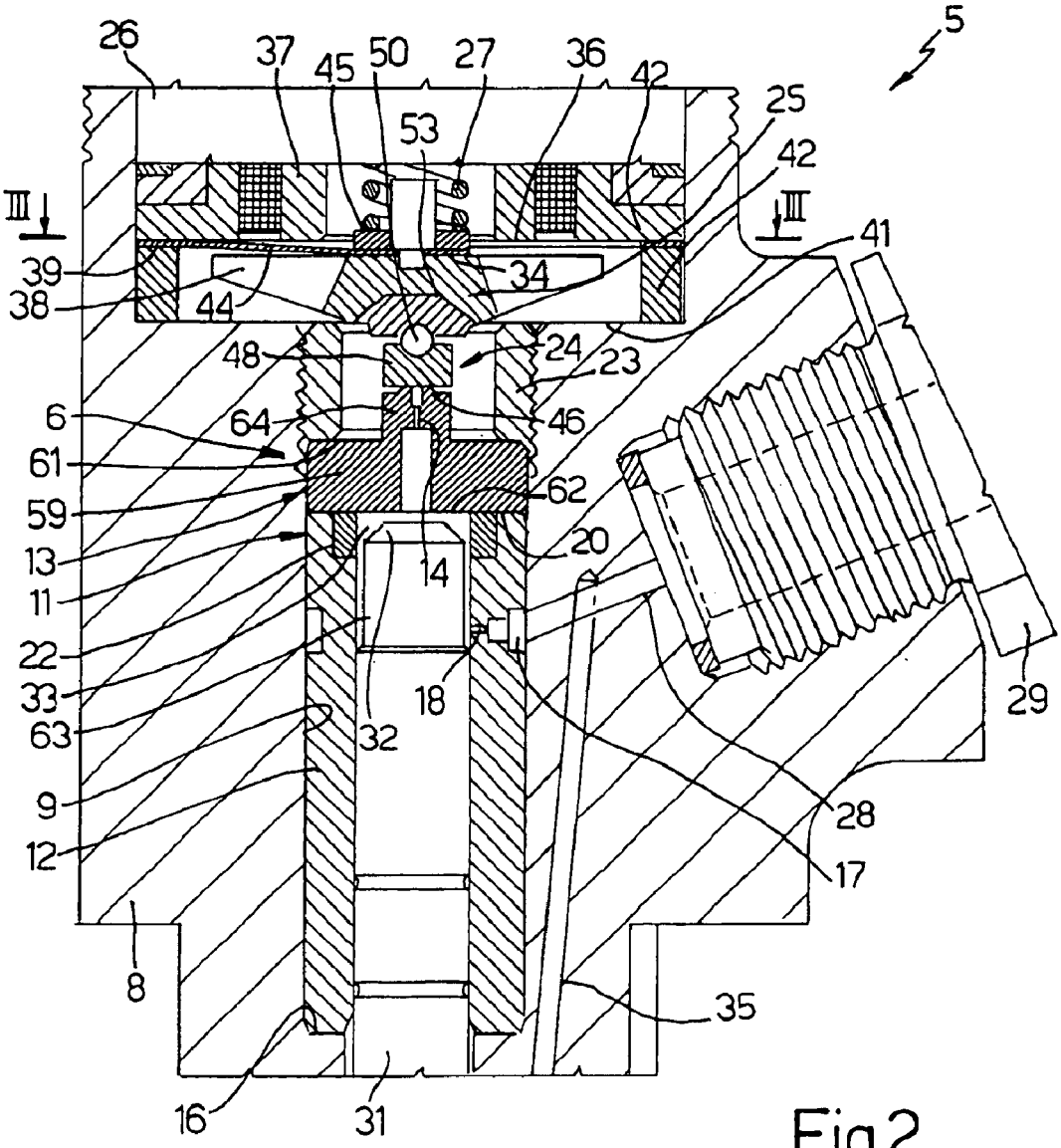
FIG. 2 shows a partial longitudinal section of a fuel injector in accordance with a further embodiment of the invention.

In the FIG. 2 embodiment, in which the same parts as in FIG. 1 are indicated using the same reference numbers with no further description, plug member 13 of valve body 11 is defined by a disk 59 having an annular top surface 61 engaged by ring nut 23, and a flat bottom surface 62. For inlet hole 18 to communicate with control chamber 33, a top portion 63 of rod 31 has a small diameter, and the gap between portion 63 and sleeve 12 increases the volume of control chamber 33.

Armature 25 has no downward-facing cylindrical appendix, and its central portion 53 is substantially flush with, or projects slightly with respect to, the bottom edge of the disk of armature 25. The central portion 46 of disk 59, on the other hand, is carried by a spacer member defined by a cylindrical appendix 64 facing disk 59 and of such a height as to enable use of a shutter 24 of limited thickness, e.g. the one in FIG. 1.

In the FIG. 2 embodiment also, surface 49 of plate 48 engages the surface of central portion 46 of disk 59 of valve body 11, and ball 50 is located between central portion 53 of armature 25 and the second surface 51 of plate 48.

As such, both plug member 13 and the disk of armature 25 in FIG. 2 are relatively cheap to produce; the movable assembly of armature 25 in FIG. 2 is lighter than in FIG. 1, thus increasing the response speed of metering valve 6; and recess 56 in portion 53 of armature 25 in FIG. 2 is closer to the fulcrum of leaf spring hinge 39 than in FIG. 1, thus reducing the transverse movement of recess 56, and therefore of ball 50 and plate 48, with respect to discharge hole 14.

Clearly, further changes and improvements can be made to the injector as described herein without, however, departing from the scope of the accompanying claims. For example, the gap between armature 25 and plug member 13 may be covered by placing both central portions 46 and 53 of plug member 13 and armature 25 on appendixes of substantially the same height; injector 5 in FIG. 1 may be provided with a valve body 11 with plug member 59 in FIG. 2, and the FIG. 2 injector may be provided with a valve body 11 with plug member 15, 19 in FIG. 1; and, in both cases, valve body 11 may be formed in one piece.

What is claimed is:

1. An internal combustion engine fuel injector having an electromagnetic metering valve, and comprising a hollow body in which is housed a valve body having a calibrated discharge hole for discharging high-pressure fuel from a control chamber of the injector; said discharge hole coming out at a flat surface of said valve body; and said metering valve comprising a plate having a flat first surface for closing said discharge hole under the control of an armature of an electromagnet; characterized in that said armature is connected to said hinge having a first portion fixed to said hollow body, and a second portion fixed to said armature; a ball being located between said armature and a second surface of said plate.

2. An injector as claimed in claim 1, characterized in that said second surface is opposite said first surface, and has a spherical-bowl-shaped recess for engaging said ball.

3. An injector as claimed in claim 1, characterized in that said and connected to said second portion of the leaf spring hinge; said armature also comprising a second surface facing said plate and having a spherical-bowl-shaped recess for engaging said ball.

4. An injector as claimed in claim 2, wherein said valve body is housed inside a cavity of said hollow body, and is locked by a threaded ring nut; characterized in that at least one of said surfaces having spherical-bowl-shaped recesses is carried by a corresponding spacer member.

5. An injector as claimed in claim 4, characterized in that said spacer member is defined by an appendix projecting from said valve body towards said armature, so as to minimize the transverse movement, caused by said leaf spring hinge, of said ball with respect to said discharge hole.

6. An injector as claimed in claim 4, characterized in that said spacer member is defined by an appendix projecting from said armature towards said valve body; said flat surface of said valve body being carried by a central portion which is coplanar with a surface of an annular portion engaged by said ring nut.

7. An injector as claimed in claim 5, characterized in that said valve body comprises a sleeve force-fitted inside said cavity; and a plug member comprising a disk-shaped portion which is locked to said sleeve by said ring nut.

* * * * *

UNITED STATES PATENT AND TRADEMARK OFFICE

CERTIFICATE OF CORRECTION

PATENT NO. : 6,874,709 B2
APPLICATION NO. : 10/271061
DATED : April 5, 2005
INVENTOR(S) : Ricco It is certified that error appears in the above-identified patent and that said Letters Patent is hereby corrected as shown below:

Column 5, line 6 insert - - hollow body by a leaf spring - - between "said" and "hinge"

Column 5, line 14, insert - - armature is in the form of a disk having a flat surface facing said electromagnet - - between "said"

and "and"

Signed and Sealed this

Eighth Day of August, 2006

JON W. DUDAS
*Director of the United States Patent and Trademark Office*